US005423890A

United States Patent [19]

More et al.

[11] Patent Number: 5,423,890

[45] Date of Patent: Jun. 13, 1995

[54] FUEL OIL ADDITIVE AND COMPOSITIONS

[75] Inventors: Iain More, Abingdon, England; Wayne M. Camarco, Woodbridge, N.J.; Darryl R. T. Smith, Swindon, England

[73] Assignee: Exxon Chemical Patents Inc., Linden, N.J.

[21] Appl. No.: 941,050

[22] PCT Filed: Apr. 8, 1991

[86] PCT No.: PCT/EP91/00669

§ 371 Date: Dec. 9, 1992

§ 102(e) Date: Dec. 9, 1992

[87] PCT Pub. No.: WO91/15562

PCT Pub. Date: Oct. 17, 1991

[30] Foreign Application Priority Data

Apr. 9, 1990 [GB] United Kingdom ..... 9007970

[51] Int. Cl.[6] ..... C10L 1/14; C10L 1/18

[52] U.S. Cl. ..... 44/393; 44/443

[58] Field of Search ..... 44/62, 443, 393

[56] References Cited

U.S. PATENT DOCUMENTS

| | | | |
|---|---|---|---|
| 4,211,534 | 7/1980 | Feldman | 44/62 |
| 4,375,973 | 3/1983 | Rossi et al. | 44/62 |
| 4,546,137 | 10/1985 | Rossi et al. | 44/62 |
| 5,045,088 | 9/1991 | More et al. | 44/393 |

FOREIGN PATENT DOCUMENTS

| | | |
|---|---|---|
| 0153176 | 8/1985 | European Pat. Off. . |
| 0153177 | 8/1985 | European Pat. Off. . |

*Primary Examiner*—C. Warren Ivy
*Assistant Examiner*—Raymond Covington
*Attorney, Agent, or Firm*—Vivienne T. White

[57] ABSTRACT

Compositions comprising an ethylene-α-olefin copolymer, an ethylene-unsaturated ester copolymer, and a comb polymer improve the low temperature properties of fuel oils, especially high wax content oils.

19 Claims, No Drawings

FUEL OIL ADDITIVE AND COMPOSITIONS

This invention relates to fuel oil compositions, and more especially to fuel oil compositions susceptible to wax formation at low temperatures, and to additive compositions for such fuel oil compositions.

Heating oils and other distillate petroleum fuels, for example, diesel fuels, contain alkanes that at low temperature tend to precipitate as large crystals of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are naturally desirable since they are less likely to clog a filter; certain additives inhibit the wax from crystallizing as platelets and cause it to adopt an acicular habit, the resulting needles being more likely to pass through a filter than are platelets. The additives may also have the effect of retaining in suspension in the fuel the crystals that have formed, the resulting reduced settling also assisting in prevention of blockages.

Effective wax crystal modification (as measured by CFPP and other operability tests, as well as simulated and field performance) may be achieved by flow improvers, mostly ethylene-vinyl acetate copolymer (EVA)-based, in distillates containing up to 4 wt %-n-alkanes at 10° C. below cloud point (wax appearance temperature), as determined by gravimetric or DSC methods.

Problems still remain, however, especially with high wax content distillates like those encountered in the Far East and Australia which although featuring similar distillation characteristics have much higher wax contents (between 5 and 10% at 10° C. below the cloud point as measured by DSC or gravimetric analysis) and different carbon number distribution. Particularly difficult to treat fuels are those with a high wax content and a relatively low final boiling point, i.e., no higher than 370° C., sometimes below 360° C., which have high wax contents over a narrow carbon number distribution. The most difficult to treat are those fuels obtained from high wax crudes such as those from the crudes in Australia and the Far East where the total n-alkane content of the distillate can be greater than 20%, the total content being $C_9$ and higher n-alkanes as measured by GLC.

The present invention is concerned to provide a fuel additive effective both to improve low temperature flow of the fuel and also to inhibit wax settling.

In one aspect, the present invention is directed to a fuel oil additive composition comprising:

(a) an ethylene-α-olefin copolymer having a number average molecular weight of at least 30,000 and an ethylene content of from 50 to 85 molar per cent, (b) an ethylene-ethylenically unsaturated monocarboxylic acid ester copolymer having an ester content of at least 10 molar per cent or an ethylene-α-olefin copolymer having a number average molecular weight of at most 7500, and (c) a comb polymer.

The invention also provides a fuel oil containing the additive composition, and an additive concentrate comprising the additive composition in admixture with a fuel oil or a solvent miscible with the fuel oil. The invention further provides the use of the additive composition to improve the low temperature properties of a fuel oil.

The ethylene-α-olefin copolymer that forms component (a) of the additive composition of the invention is a copolymer of ethylene and at least one α-olefin, preferably one having at most 20 carbon atoms. Examples of such olefins are propylene, 1-butene, isobutene, n-octene-1, isooctene-1, n-decene-1, and n-dodecene-1. The copolymer may also comprise small amounts, e.g., up to 10% by weight of other copolymerizable monomers, for example olefins other than α-olefins, and non-conjugated dienes. The preferred copolymer is an ethylene-propylene copolymer. It is within the scope of the invention to include two or more different copolymers each within the terms of (a).

The molecular weight of the copolymer forming component (a) is, as indicated above, at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000. (All molecular weights given in this specification, including the claims, are number average molecular weights.)

As indicated above, the copolymer has a molar ethylene content between 50 and 85 per cent. Advantageously, the ethylene content is within the range of from 57 to 80%, and preferably it is in the range from 58 to 73%; more preferably from 62 to 71%, and most preferably 65 to 70%.

Advantageously copolymers for component (a) are ethylene-propylene copolymers with a molar ethylene content of from 62 to 71% and a number average molecular weight in the range 60,000 to 120,000, preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble at fuel oil at low temperatures.

The copolymer forming component (b) of the additive composition may be a copolymer of ethylene with an unsaturated monocarboxylic acid ester. The ester may be an ester of an unsaturated carboxylic acid with a saturated alcohol or, which is preferred, an ester of a saturated carboxylic acid with an unsaturated alcohol. Examples of the former are methyl acrylate, ethyl acrylate, butyl acrylate, methyl methacrylate, ethyl methacrylate, butyl methacrylate, lauryl acrylate, isopropyl acrylate, and isobutyl acrylate. Examples of the latter are vinyl acetate, propionate, butyrate, and isobutyrate. The preferred copolymer is an ethylene-vinyl acetate copolymer.

As indicated above, the copolymer contains at least 10 molar per cent of the ester. Advantageously, the copolymer contains at least 12 molar per cent of the ester.

Alternatively, the copolymer may be an ethylene-α-olefin copolymer, with a number average molecular weight of at most 7500, advantageously from 1,000 to 6,000, and preferably from 2,000 to 5,000, as measured by vapour phase osmometry. Appropriate α-olefins are as given above with reference to component (a), or styrene, with propylene again being preferred. Advantageously the ethylene content is from 60 to 77 molar per cent although for ethylene-propylene copolymers up to 86 molar per cent by weight ethylene may be employed with advantage.

The number average molecular weight of the ethylene-unsaturated ester copolymer is advantageously at most 7,500, and is more advantageously in the range of 850 to 4,000, preferably 1,250 to 3,500, and most preferably about 3,000, as measured by vapour phase osmometry.

The polymers of component (b) may be made by any of the methods known in the art, e.g., by solution polymerization with free radical initiation.

It is within the scope of the invention to include two or more copolymers each within the terms of (b).

The copolymer forming component (c) is a comb polymer. Such polymers are discussed in "Comb-Like Polymers. Structure and Properties", N. A. Platé and V. P. Shibaev, J. Poly. Sci. Macromolecular Revs., 8, p 117 to 253 (1974).

As examples of comb polymers there may be mentioned those of the general formula

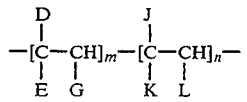

wherein

D=R, COOR, OCOR, $R^2$COOR, or OR,

E=H, $CH_3$, D, or $R^2$,

G=H or D

J=H, $R^2$, $R^2$COOR, or an aryl or heterocyclic group,

K=H, $COOR^2$, $OCOR^2$, $OR^2$, or COOH,

L=H, $R^2$, $COOR^2$, $OCOR^2$, COOH, or aryl, $R \geqq C_{10}$ hydrocarbyl, $R^2 \geqq C_1$ hydrocarbyl, and m and n represent mole ratios, m being within the range of from 1.0 to 0.4, n being in the range of from 0 to 0.6. R advantageously represents a hydrocarbyl group with from 10 to 30 carbon atoms, while $R^2$ advantageously represents a hydrocarbyl group with from 1 to 30 carbon atoms.

The comb polymer may contain units derived from other monomers if desired or required. It is within the scope of the invention to include two or more different copolymers each within the terms of (c).

These comb polymers may be copolymers of maleic anhydride or fumaric acid and another ethylenically unsaturated monomer, e.g., an α-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerised with e.g., maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-ocatadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^2$ refers to the average number of carbon atoms in the alkyl group; if alcohols that contain a branch at the 1 or 2 positions are used $R^2$ refers to the straight chain backbone segment of the alcohol.

These comb polymers may especially be fumarate polymers and copolymers such for example as those described in European Patent Applications 0153176 and 0153177.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

The additive composition advantageously comprises from 3 to 40% by weight of component (a), from 50 to 85% by weight of component (b) and from 3 to 25% by weight of component (c). A more advantageous range for component (a) is 3 to 25% by weight. Where an admixture of two or more representatives of a component is used, the percentages refer to the total weight of the component representatives. Preferred compositions contain from 10 to 22% of component (a), from 58 to 78% of component (b) and from 7 to 20% of component (c). When component (c) is a mixture of $C_{14}$ fumarate and mixed $C_{14}/C_{16}$ fumarate, as is preferred as discussed above, the ratio of $C_{14}$ to $C_{14}/C_{16}$ is advantageously 1:1 to 4:1, preferably 2:1 to 7:2, and most preferably about 3:1, by weight.

Additive compositions provided by the invention improve low temperature performance of fuel oils in a number of respects, including lowering pour point, CFPP and, more especially, inhibiting wax settlement at temperatures below the cloud point. The last-mentioned improvement is especially noticeable, compared with additive compositions commercially available or others previously proposed, with high wax content fuel oils, especially with Chinese crudes, and the invention more especially provides a high, i.e., at least 5% at 10° C. below cloud point, wax content fuel containing the additive composition of the invention.

The additive composition and the fuel oil composition may contain other additives for improving low temperature properties, many of which are in use in the art or known from the literature. Among them there may be mentioned ethylene-unsaturated monocarboxylic acid ester copolymers falling outside the definition of component (b), for example, an ethylene-vinyl acetate copolymer with a molar content of vinyl acetate less than 10%. Also there may be mentioned polar nitrogen compounds for example those described in U.S. Pat. No. 4,211,534, especially an amide-amine salt of phthalic anhydride with two molar proportions of hydrogenated tallow amine, or the corresponding amide-amine salt of ortho-sulphobenzoic anhydride.

In addition, the additive composition and the fuel oil composition may contain additives for other purposes, e.g., for reducing particulate emission or inhibiting colour and sediment formation during storage.

The fuel oil composition of the invention may contain the additive of the invention, i.e., the three specified components (a), (b) and (c), in a total proportion of 0.005% to 1%, advantageously 0.025 to 0.5%, and preferably 0.05 to 0.125% by weight, based on the weight of fuel.

The following Examples, in which all parts and percentages are by weight unless otherwise indicated, illustrate the invention. The fuel oil designated in the Examples as NB2VG08 is a Nanjing blend having a CFPP (measured as described in "Journal of the Institute of Petroleum", 52 (1966), pp 173 to 185) of 4° C., and a pour point of 9° C. as measured by ASTM D 97.

Details of the blend and its components are given in Table 1 below.

TABLE 1

| Component Type | % of Blend | Distillation, (ASDA D86) °C. IBP | 10 | 50 | 90 | FBP | WAT °C. | Wax Content % |
|---|---|---|---|---|---|---|---|---|
| 2nd Sidestream | 20 | 122 | 216 | 276 | 322 | 357 | −10.0 | 4.9/10.0 |
| 3rd Sidestream | 24 | 220 | 291 | 321 | 346 | 359 | 12.8 | 7.6/14.9 |
| TCD | 25 | 192 | 237 | 273 | 313 | 338 | −8.0 | 3.7/6.6 |
| FCC | 25 | 210 | 234 | 281 | 331 | 348 | 0 | 3.9/6.0 |
| VGO 2 | 6 | 231 | 294 | 380 | 455 | 512 | 34 | 3.4/8.2 |
| Blend | 100 | 208 | 240 | 290 | 340 | 374 | 3.5 | 2.5/5.3 |

TCD: Thermally Cracked Diesel
FCC: Catalytically Cracked Component
VGO 2: Vacuum Gas Oil

EXAMPLES 1 TO 4

In these Examples, the effectiveness of an additive according to the invention in preventing wax settlement and lowering pour point and CFPP of Fuel Blend NB2VG08 was compared with that of a commercially available additive (referred to below as Additive A) containing 63.2% of an ethylene-vinyl acetate copolymer (15.5 mol % vinyl acetate, molecular weight about 2000), 20.8% ethylene-vinyl acetate copolymer (4.6 mol % vinyl acetate, molecular weight about 3000), 9.4% $C_{14}$ ester of fumaric acid/vinyl acetate copolymer, referred to below as $C_{14}$ FVA, and 6.6% mixed $C_{14}/C_{16}$ ester of the same copolymer, referred to below as $C_{14}/C_{16}$ FVA. In the additive according to the invention in these Examples, the ethylene-vinyl acetate copolymer used (referred to below as EVA 36), was the same as the 15.5% vinyl acetate copolymer mentioned above, and the $C_{14}$ and $C_{14}/C_{16}$ FVA's were the same as in the comparison material. The treat rate in each case was 750 ppm. The ethylene propylene copolymer contained 65% ethylene and had a molecular weight of 87700.

The measurement of the extent of wax settlement was carried out by cooling a sample of fuel, filling a 100 ml measuring cylinder, at 1° C. per hour to 0° C. and maintaining it at that temperature for a given period, measuring the height of the top of the wax layer formed, and expressing that height as a percentage of the height of fuel in the cylinder. The results are shown in Table 2 below.

TABLE 2

| Example No. | PROPORTIONS, % by weight EVA 36 | EPC | $C_{14}$FVA | $C_{14/16}$FVA | CFPP °C. | WAX % 6 DAYS | POUR POINT °C. |
|---|---|---|---|---|---|---|---|
| 1 | 75.1 | 9.1 | 12.0 | 4.0 | −1.5 | 100 | −18 |
| 2 | 63.2 | 20.8 | 12.0 | 4.0 | −0.5 | 100 | −15 |
| 3 | 63.2 | 20.8 | 9.4 | 6.6 | 0.0 | 100 | −12 |
| 4 | 50.0 | 34.0 | 12.0 | 4.0 | 1.0 | 100 | −12 |
| ADDITIVE A | | | | | −2 | 45 | −12 |
| NO ADDITIVE | | | | | 4 | SOLID | 9 |

EXAMPLES 5 TO 10

Additive compositions with components in the proportions given in Example 2 were made up except that ethylene propylene copolymers of different molecular weight were used. The effect on the properties of a fuel blend (NB2VG08) containing 750 ppm of the additive is shown in Table 3 below.

TABLE 3

| | Ethylene Mol % | Mn 1000's | CFPP °C. | POUR POINT °C. | WAX % 6 DAYS |
|---|---|---|---|---|---|
| Comparison B | 69 | 1.6 | 0.5 | −14.5 | 32 |
| Comparison C | 65 | 3.5 | 0 | −14.5 | 35 |
| Example 5 | 65 | 33 | −0.5 | −14.5 | 79 |
| Example 6 | 65 | 45 | 0 | −19.5 | 92 |
| Example 7 | 65 | 60.3 | 1.0 | −21 | 90 |
| Example 8 | 65 | 79 | 0 | −18 | 93 |
| Example 9 | 67 | 89.5 | 0 | −24 | 98 |
| Example 10 | 65 | 135 | 0 | −16.5 | 93 |

EXAMPLES 11 TO 14

The effect on wax settlement at 0° C. in NB2VG08 fuel of varying the proportion of ethylene propylene copolymer in the additive composition is shown in these examples. Each additive composition contained 6% $C_{14}$ FVA, 2% $C_{14/16}$ FVA and 92% total weight of EVA 36 and the ethylene propylene copolymer used in Examples 1 to 4, and was used at a treat rate of 750 ppm. The results are shown in Table 4.

TABLE 4

| | EPC Content | WAX, % | | | |
|---|---|---|---|---|---|
| | Weight % | Day 1 | Day 3 | Day 6 | Day 21 |
| Comparison D | 0 | 30 | 27 | 26 | 27 |
| Example 11 | 3 | 85 | 71 | 60 | 43 |
| Example 12 | 5 | 90 | 81 | 70 | 50 |
| Example 13 | 8 | 94 | 88 | 78 | 53 |
| Example 14 | 12 | 98 | 92 | 84 | 60 |

Similar results were obtained with an additive containing 12% $C_{14}$ FVA and 4% $C_{14/16}$ FVA, remainder EVA 36 and the ethylene propylene copolymer. The wax in the comparison sample settled to the 35% level in 5 days; after 1 day samples containing the ethylene propylene copolymer at levels ranging from 2.6 to 20.8 wt % had wax at levels between 90 and 100%; after 6 days the levels ranged between 76 and 92% and after 21 days the levels ranged between 48 and 72%.

EXAMPLES 15 TO 19

The effect of varying treat rate is shown in these examples. The additive composition comprised 63.2% of EVA 36, 20.8% of the ethylene propylene copolymer of Example 1, 12% of $C_{14}$ FVA and 4% of $C_{14/16}$ FVA. The fuel was NB2VG08, wax settlement being measured as described in Example 1. The results are as shown in Table 5 below.

TABLE 5

| Example No. | Treat Rate ppm | Pour Point °C. | CFPP °C. | WAX % 2 days | WAX % 6 days |
|---|---|---|---|---|---|
| 15 | 100 | 6 | 2 | 100 | 100 |
| 16 | 250 | 6 | 1 | 100 | 98 |
| 17 | 500 | −21 | 0 | 100 | 99 |
| 18 | 750 | −21 | 0 | 100 | 99 |
| 19 | 1000 | −21 | −2 | 100 | 100 |

EXAMPLES 20 TO 26

In these examples, different comb polymers are employed, the composition otherwise, and the fuel and treat rate, being as in Example 18. The results are shown in Table 6 below. In each case two comb polymers are employed, Comb Polymer 1 being at 12%, and Comb Polymer 2 at 4%, of the composition.

TABLE 6

| Example No. | Comb Polymer 1 | Comb Polymer 2 | CFPP °C. | WAX % 2 days | WAX % 6 days |
|---|---|---|---|---|---|
| 20 | $C_{14}$ polyfumarate | $C_{14/16}$ polyfumarate | 3.5 | 92 | 64 |
| 21 | $C_{14}$ IVA | $C_{14/16}$ IVA | 0 | 99 | 97 |
| 22 | $C_{14}$ polyitaconate | C14/16 polyitaconate | 0 | 67 | 51 |
| 23 | $O_{10}ME_{14}$ | $O_{16}ME_{14}$ | −1 | 95 | 70 |
| 24 | $O_{18}ME_{12}$ | $O_{16}ME_{14}$ | 2 | 97 | 75 |
| 25 | $C_{14}$MEVEME | $C_{14/16}$ MEVEME | −0.5 | 98 | 86 |
| 26 | $C_{14}$FVA | $C_{14/16}$ FVA | 0 | 100 | 98 |
| | Additive A | | −1 | 56 | 45 |

IVA: itaconate vinyl acetate copolymer
$O_nME_m$: $C_n$ olef in maleic $C_m$ ester copolymer
$C_m$ MEVEME: methyl vinyl other maleate $C_m$ ester copolymer.

EXAMPLES 27 TO 32

These examples illustrate the effect of varying the ethylene content of the ethylene-propylene copolymer. The base composition contained 63.2% EVA 36, $C_{14}$ FVA 12%, $C_{14/16}$ FVA 4%, and ethylene propylene copolymer (of number average molecular weight about 100,000) 20.8%. The base fuel was NB2VG08, and the treat rate was 750 ppm. The results are shown in Table 7.

TABLE 7

| Example | Ethylene Mol % | CFPP °C. | WAX % 2 days | WAX % 6 days |
|---|---|---|---|---|
| Comparison E | 50.6 | −1.5 | 61 | 45 |
| 27 | 58.9 | −2 | 94 | 83 |
| 28 | 63.2 | 0 | 97 | 92 |
| 29 | 69.1 | 1 | 100 | 98 |
| 30 | 71.4 | 1 | 98 | 93 |
| 31 | 74.7 | 0 | 94 | 71 |
| 32 | 78.4 | −0.5 | 95 | 80 |

EXAMPLE 28

This example shows that all three components of the composition are necessary to achieve good wax settlement results in NB2VG08. Compositions using a polar nitrogen compound instead of the ethylene propylene copolymer or instead of the comb polymer gave poor results, as shown in Table 8 below. The values in the component column are in ppm, based on the fuel. The ethylene propylene copolymer (EPC) was that used in Example 2.

The polar nitrogen compound was the amide/amine salt of phthalic anhydride and hydrogenated tallow amine.

TABLE 8

| EVA 36 | EPC | $C_{14}$FVA | $C_{14/16}$FVA | N COMPOUND | CFPP °C. | WAX % 2 days | WAX % 6 days |
|---|---|---|---|---|---|---|---|
| 474 | 155 | 90 | 30 | — | −1 | 100 | 100 |
| 474 | — | 90 | 30 | 155 | −3 | 57 | 38 |
| 632 | — | 120 | 40 | 207 | −4 | 58 | 40 |
| 474 | 155 | — | — | | 3 | 97 | 51 |
| 632 | 207 | — | — | 120 | 1 | 98 | 72 |

EXAMPLES 29 TO 32

A number of commercially available EPC polymers were incorporated into an additive composition and tested in Fuel Blend NB2VG08 for effectiveness; the additive comprises 63.2% EVA 36, 20.8% EPC, 12% $C_{14}$FVA and 4% $C_{14/16}$FVA. Polymer 1 contains 75 molar % ethylene, $M_n$ about 72000; Polymer 2 contains 54% ethylene, $M_n$ about 40000, and Polymer 3 is a 40:60 by weight blend of polymers 1 and 2. The treat rate given is treat rate for the additive composition. As is apparent from Table 9, the polymer with 54% ethylene is not effective in inhibiting wax settlement in this fuel blend.

TABLE 9

| Example No. | EPC | Treat Rate ppm | CFPP °C. | WAX % 6 days |
|---|---|---|---|---|
| 29 | Polymer 1 | 750 | 1 | 100 |
| 30 | Polymer 1 | 1000 | −0.5 | 99 |
| 31 | Polymer 3 | 750 | −1.5 | 94 |
| 32 | Polymer 2 | 750 | 0.5 | 35 |

We claim:

1. A fuel oil additive composition comprising:

(a) an ethylene-α-olefin copolymer having a number average molecular weight of at least 30,000 and an ethylene content of from 50 to 85 molar percent, (b) an ethylene-ethylenically unsaturated monocarboxylic acid ester copolymer having an ester content of at least 10 molar percent or an ethylene-α-olefin polymer having a number average molecular weight of at most 7500, and (c) a comb polymer, having the general formula

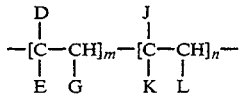

wherein

D=R, COOR, OCOR, $R^2$COOR, or OR,

E=H, $CH_3$, D, or $R^2$,

G=H or D

J=H, $R^2$, $R^2$COOR, or an aryl or heterocyclic group,

K=H, $COOR^2$, $OCOR^2$, $OR^2$, or COOH,

L=H, $R^2$, $COOR^2$, $OCOR^2$, COOH, or aryl,

R≧$C_{10}$ hydrocarbyl, $R^2$≧$C_1$ hydrocarbyl, and m and n represent mole ratios, m being within the range of from 1.0 to 0.4, n being in the range of from 0 to 0.6; and wherein component (c) is different from component (a) and component (b).

2. An additive composition as claimed in claim 1, wherein component (a) is an ethylene-propylene copolymer.

3. An additive composition as claim in claim 1, wherein component (a) has a molecular weight within the range of from 60,000 to 120,000.

4. An additive composition as claimed in any one of claims 1, 2, or 3, wherein component (a) has an ethylene content between 58 and 73%.

5. An additive composition as claimed in claim 4, wherein component (a) has an ethylene content between 62 and 71%.

6. An additive composition as claimed in claim 5, wherein component (a) has an ethylene content between 65 and 70%.

7. An additive composition as claimed in any one of claims 1, 2, 3, 5, 6, wherein component (b) is an ethylene-unsaturated ester polymer and contains at least 12% of the ester.

8. An additive composition as claimed in claim 7, wherein component (b) is an ethylene-unsaturated ester polymer with a molecular weight of at most 7500.

9. An additive composition as claimed in claim 1, wherein component (b) is an ethylene-vinyl acetate copolymer.

10. An additive composition as claimed in claim 1, wherein the comb polymer is a copolymer of vinyl acetate and a fumarate ester.

11. An additive composition as claimed in claim 10, wherein the ester groups are alkyl groups having from 12 to 20 carbon atoms.

12. A fuel oil composition comprising an additive composition as claimed in any one of claims 1, 2, 3, 5, 6, 8, 4, 10.

13. A composition as claimed in claim 12, which contains components (a), (b) and (c) in a total proportion of from 0.005 to 1%, based on the weight of fuel.

14. A composition as claimed in claim 12, wherein the fuel oil has a wax content of at least 5%, at 10° C. below cloud point.

15. An additive concentrate comprising the composition defined in claim 1 in a fuel oil or a solvent miscible with fuel oil.

16. A fuel oil additive composition comprising:

(a) an ethylene-α-olefin copolymer having a number average molecular weight of at least 30,000 and an ethylene content of from 50 to 85 molar per cent, (b) an ethylene-ethylenically unsaturated monocarboxylic acid ester copolymer having an ester content of at least 10 molar per cent, and (c) a comb polymer of the general formula

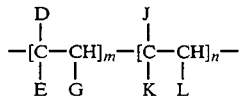

wherein

D=R, COOR, OCOR, $R^2$COOR, or OR,

E=H, $CH_3$, D, or $R^2$,

G=H or D

J=H, $R^2$, $R^2$COOR, or an aryl or heterocyclic group,

K=H, $COOR^2$, $OCOR^2$, or $OR^2$, or COOH,

L=H, $R^2$, $COOR^2$, $OCOR^2$, COOH, or aryl,

R≧$C_{10}$ hydrocarbyl, $R^2$≧$C_1$ hydrocarbyl, and m and n represent mole ratios, m being within the range of from 1.0 to 0.4, n being in the range of from 0 to 0.6.

17. An additive concentrate comprising the composition defined in claim 16 in a fuel oil or a solvent miscible with fuel oil.

18. The use of an additive composition as claimed in claim 16 to improve the low temperature properties of a fuel oil.

19. A fuel oil additive composition comprising:

(a) an ethylene-α-olefin copolymer having a number average molecular weight of at least 30,000 and an ethylene content of from 50 to 85 molar per cent, (b) an ethylene-ethylenically unsaturated monocarboxylic acid ester copolymer having an ester content of at least 10 molar per cent, and (c) a comb polymer having a backbone with units derived from ethylenically unsaturated monomers, at least 40 molar per cent of which units carry a side chain of at least 6 atoms.

* * * * *